US008695500B2

(12) United States Patent
Faber

(10) Patent No.: US 8,695,500 B2
(45) Date of Patent: Apr. 15, 2014

(54) SELF-INKING HAND STAMP COMPRISING A HOUSING

(75) Inventor: Ernst Faber, Wels (AT)

(73) Assignee: Colp Stempelerzeugung Skopek Gesellschaft m.b.H. & Co. KG, Wels (AT)

( * ) Notice: Subject to any disclaimer, the term of this patent is extended or adjusted under 35 U.S.C. 154(b) by 319 days.

(21) Appl. No.: 13/199,718

(22) Filed: Sep. 7, 2011

(65) Prior Publication Data

US 2012/0067233 A1 Mar. 22, 2012

(30) Foreign Application Priority Data

Sep. 16, 2010 (AT) ..... 1544/2010

(51) Int. Cl.
*B41K 1/36* (2006.01)
*B41K 1/38* (2006.01)

(52) U.S. Cl.
USPC ..... 101/327; 101/334; 101/104; 377/15

(58) Field of Classification Search
USPC ..... 101/103, 104, 105, 327, 333, 334, 405, 101/406; 377/15
See application file for complete search history.

(56) References Cited

U.S. PATENT DOCUMENTS

| | | | | |
|---|---|---|---|---|
| 4,532,642 | A | 7/1985 | Morris et al. | |
| 5,271,322 | A * | 12/1993 | Palma | 101/333 |
| 7,389,727 | B2 | 6/2008 | Faber | |
| 7,677,172 | B2 | 3/2010 | Faber | |
| 7,954,429 | B1 * | 6/2011 | Abukhdair | 101/327 |

FOREIGN PATENT DOCUMENTS

| | | |
|---|---|---|
| CH | 86031 | 7/1920 |
| CN | 2185677 | 12/1994 |
| CN | 2616380 | 5/2004 |
| CN | 2730628 | 10/2005 |
| CN | 2900178 | 5/2007 |
| CN | 201214319 | 4/2009 |
| CN | 201309308 | 9/2009 |
| DE | 297 03 669 | 4/1997 |
| JP | 05-016512 | 1/1993 |
| JP | 2005-193517 | 7/2005 |
| TW | 576807 | 2/2004 |
| WO | WO 2004/082949 | 9/2004 |

OTHER PUBLICATIONS

Austrian Office Action dated Jun. 3, 2011 in Austrian Application No. A 1544/2010 with English translation of relevant parts.

* cited by examiner

*Primary Examiner* — Leslie J Evanisko
(74) *Attorney, Agent, or Firm* — Collard & Roe, P.C.

(57) ABSTRACT

A self-inking stamp includes a housing, in which an ink pad holder adapted to receive an ink pad and a stamping unit including stamp types are arranged. The ink pad holder is replaceably arranged in the housing. An actuating member is slidably mounted on the housing and is coupled with a turn-over mechanism for pivoting the stamping unit between a coloring position and a print position. A signal generator records a movement of the actuating member into an actuating position corresponding to the print position. An electronic evaluating unit including a counting module is connected to the signal generator for processing a signal supplied by the signal generator. A switching member is connected to the evaluating unit and is arranged to be switched from a first switching state to a second switching state when the ink pad holder is inserted or removed.

19 Claims, 7 Drawing Sheets

Fig. 1 PRIOR ART

Fig. 2 PRIOR ART

SELF-INKING HAND STAMP COMPRISING A HOUSING

CROSS REFERENCE TO RELATED APPLICATIONS

Applicant claims priority under 35 U.S.C. §119 of Austrian Application No. A 1544/2010 filed on Sep. 16, 2010, the disclosure of which is incorporated by reference.

FIELD OF INVENTION

The invention generally relates to a self-inking stamp. More in detail, the invention relates to a self-inking stamp with a housing in which an ink pad holder adapted to receive an ink pad and a stamping unit with stamp types are arranged, and with an actuating yoke slidably mounted on the housing, which is coupled to a turn-over mechanism for pivoting the stamping unit between a colouring position supported against the ink pad during operation and a print position provided for printing on a print surface.

BACKGROUND OF INVENTION

Self-inking stamps with integrated ink pad are, for example, known from WO 2004/082949. The self-inking pad shown in this document comprises a hood-like actuating yoke which is mounted on a compact stamp housing. For stamping the actuating yoke is moved against the force of a spring arranged between stamp housing and actuating yoke in direction of a print surface, wherein a stamping unit supported against the ink pad during inking in an upside down position is turned by 180° in order to bring the stamp types attached to the stamping unit into contact with the print surface.

Self-inking stamps of this kind have proved a great success in the market because they considerably simplify the stamping operation compared to conventional manual stamps with separate ink pad. However, with known self-inking stamps there is no practical way of drawing conclusions as to the condition or colouring capacity of the existing ink pad. Besides it would be desirable if some information about the already performed actuating operations could be obtained.

U.S. Pat. No. 4,532,642 A further discloses a generic manual stamp with turn-over mechanism which comprises an electric switch in the handle, which switch is connected to a pressure-sensitive element. The electric switch is activated with each stamping operation in order to inform a counting circuit thereof. However, the counting circuit here is arranged outside the stamp housing in a lockable box; a line with a plug is provided for connection to the electric switch of the manual stamp and the plug is connected to the counting circuit.

Further, it has been proposed in CN 2 900 178 Y, JP 05-016 512 A, CN 201 309 308 Y, CN 201214319 Y, JP 2005-193517 A, CN 2616380 Y, CN 2185677 Y and CN 2730628 Y in connection with pre-inked manual stamps of a different kind, where the ink reservoir is contained in the stamping plate, to provide a counter for recording the stamp actuations. With such pre-inked stamps the imprint is produced by merely pressing slightly on the stamp handle in order to displace the stamp plate for a comparatively short distance. Recording these up and down movements is unreliable so that erroneous counts cannot be excluded.

DE 297 03 669 U1 discloses a further manual stamp without turn-over mechanism, which comprises an electronic counter integrated in the stamp handle. The stamp comprises a frame with longitudinal linear guides in which a stamping module is slidably mounted. The stamping module is moved by means of a yoke-shaped stamp upper part connected to the stamp handle from the idling position into the stamping position. The stamp frame comprises a magnetic relay on its top. The relay interacts with a permanent magnet on the stamp upper part. When the stamp is actuated the permanent magnet approaches the magnetic relay in such a way that the contacts of the magnetic switch are closed due to the magnetic effect, wherein an electric pulse is sent to the counter in order to increment the count value of the stamping operations. The count value is indicated on the LCD display of the stamp handle.

Further a stamp with a mechanical counter is proposed in CH 86031 A.

In a different context TW 576807 B deals with pluggings into which RFID markings are integrated.

SUMMARY OF THE INVENTION

It is an object of the invention to ensure that the actuating operations are reliably recorded on a self-inking stamp of the kind mentioned above.

It is a further object of the invention that the self-inking stamp shall be able to be re-used after the ink pad is exhausted.

Furthermore, it is an object of the invention to indicate the presence or absence of the ink pad in the housing.

According to one aspect of the invention a self-inking stamp comprises:

a housing, in which an ink pad holder adapted to receive an ink pad and a stamping unit comprising stamp types are arranged, wherein the ink pad holder is replaceably arranged in the housing, an actuating member slidably mounted on the housing, which actuating member is coupled with a turn-over mechanism for pivoting the stamping unit between a colouring position in which it is held against the ink pad in the ink pad holder and a print position provided for printing on a print surface, a signal generator adapted to record a movement of the actuating member into an actuating position corresponding to the print position, an electronic computing or evaluating unit, which is connected to the signal generator for processing or evaluating a signal supplied by the signal generator, wherein the computing or evaluating unit comprises a counting module for counting the actuating operations, and a switching member connected to the computing or evaluating unit, which switching member is arranged to be switched from a first switching state to a second switching state when the ink pad holder is inserted or removed.

From continuously recording individual actuations of the self-inking stamp conclusions can be drawn as regards the condition or inking capacity of the ink pad used, which contains ink for a certain number of stamping imprints. Therefore, checking the ink pad does not require removing the ink pad holder from the self-inking stamp which constitutes a considerable simplification in handling the stamp. The counting module produces a count of the stamping operations which gives information on the total number of all previous actuations. In use, the signal generator monitors the position of the actuating member or yoke which guides the stamping unit into the print position via the turn-over mechanism. The signal generator is designed to signal a stamping operation only if the actuating yoke has actually reached the actuating position corresponding to the print position; an incomplete movement of the actuating yoke, on the other hand, is ignored in order to reliably avoid erroneous counts. This ensures that the stamping operations are recorded very accurately thereby allowing specific conclusions to be drawn as regards the state of the ink pad.

In order to be able to continue using the self-inking stamp after the ink pad is exhausted, the ink pad holder is replaceably arranged in the housing. In connection therewith, it is provided according to the invention that the switching member or means connected to the computing or evaluating unit is switched over when the ink pad holder is inserted or removed. In this way, the computing or evaluating unit can ascertain whether an ink pad holder happens to be present in the housing or whether the existing ink pad holder is new. Depending upon the switching state of the switching means, which preferably is a button or a switch, the presence or absence of the ink pad holder is signalled to the computing or evaluating unit.

In order to restart counting the actuating operations after replacing a used-up ink pad, it is advantageous if the computing or evaluating unit is adapted to reset the counting module when inserting an unused ink pad holder. Inserting an unused ink pad holder may be detected by continuously monitoring the switching states of the switching means which signal the presence of the ink pad holder or the state of the ink pad holder. If the switching states of the switching means indicate that an ink pad holder is present on the one hand and this ink pad holder has not as yet been used, the counting module sets the count to zero.

In a preferred embodiment, the actuating operations are recorded by providing electro-mechanical signal generating means, in particular a push button. When the end or actuating position of the actuating yoke is reached, the push button closes an electrical contact resulting in an electrical signal which is transmitted to the computing or evaluating unit. Accordingly, the count recorded by the counting module is incremented by one ("1").

In a further preferred embodiment, electro-optical signal generating means are provided, such as in particular in the form of a photoelectric barrier. Such photoelectric barriers are known as such in many implementations in the state of the art. When the actuating yoke is moved, a photoelectric barrier is preferably introduced into the optical path of the electro-optical signal generating means; interruption of the beam is registered by the signal generating means. As the print position is reached, a signal is delivered which is processed by the computing or evaluating unit and the count of the counter in the counting module is incremented accordingly. The photoelectric barrier may be implemented as a one-way barrier with the transmitter and receiver arranged on opposing sides; alternatively, a reflective light barrier may be provided in which the signal light is reflected back by a reflector onto the transmitter/receiver.

According to a further preferred variant, inductive or capacitive signal generating means are provided. During the actuating operation a suitable actuating or trigger element coupled to the actuating yoke is approximated to a coil or a capacitor causing a change in the output voltage of the signal generating means; when a predetermined threshold value for the change in the output voltage is exceeded, a stamping operation is detected.

In order to provide information relating to the ink pad holder in a simple manner, it is favourable if the ink pad holder comprises a transponder, in particular a RFID transponder, for identifying an ink pad holder by means of an external reading device. The (RFID) transponder provides a simple cost-effective means for identifying or localising an ink pad holder inserted in the stamp housing. For reading out data contained in the transponder, in particular a code specific to the respective ink pad holder, a special reading device is used which generates short range magnetic alternating fields or radio waves which are received by the transponder and modulated in a suitable manner. Preferably a stand-alone or passive transponder is provided which is supplied with energy from the external reading device.

In order to read the data recorded by the computing or evaluating unit it is advantageous if the transponder comprises a memory which in particular contains the number of actuating operations recorded by the counting module. To this end, the transponder is connected to the computing or evaluating unit which preferably transmits data to the transponder relating to the number of actuating operations performed during the examination period. It goes without saying that all sorts of different data may be stored in the transponder. The data may have been stored in the memory of the transponder at the factory or transmitted constantly or periodically during use by the computing or evaluating unit.

In a preferred embodiment, the ink pad holder comprises a marker or marking means for detecting an unused or used state of the ink pad holder. The marking means signal, via their state of change during the first actuating operation, that an ink pad holder inserted in the housing has already been used, which can be of interest when buying stamps.

In order to achieve an embodiment which is constructionally simple and can be produced in a cost-effective way, it is advantageous if the marking means comprise a lug or strap attached to the ink pad holder, which is detached when the actuating yoke is moved into the actuating position for the first time. To detach the lug a projection is preferably provided on the actuating yoke which during the actuating operation hits the lug and breaks it off during further movement of the actuating yoke. The connection between the lug and the ink pad holder is preferably chosen such that a manual force commonly used for exerting pressure upon the stamp is sufficient to sever the lug during the first operation. Thus, the missing strap indicates immediately that the ink pad holder had already been used.

To automatically record the state of the ink pad holder it is favourable if the lug, in the unused state of the ink pad holder establishes a contact with a switching means connected to the computing or evaluating unit which contact is interrupted when the lug is detached. The first-time use of the stamp causes a change in the switching state of the switching means preferably formed as a switch or push button. The change in the switching state is recorded by the computing or evaluating unit in order to ascertain the used state of the ink pad holder. The information relating to the state of the ink pad holder may, for example, be stored in a memory of the computing or evaluating unit and read out as needed.

For processing the signals of the signal generating means it is favourable if the computing or evaluating unit is a micro controller. This can be used to additionally achieve a space-saving arrangement of the computing or evaluating unit in the self-inking stamp, in particular in the stamp housing.

In order to inform the user of the state of the ink pad holder it is advantageous if the computing or evaluating unit is connected to a display unit for displaying a display signal dependent upon the number of actuating operations. The display signal may provide, on the one hand, an exact indication of the number of actuating operations at the respective point in time; in many cases, however, it is sufficient if the display signal shows a certain interval of recorded actuating operations (for example less than 4000 cycles, between 4000 and 5000 cycles, more than 5000 cycles). In this case therefore only a small number of distinguishable display signals is required, permitting a simple circuit design for the display unit, for example using only three different display means.

To this end it is particularly favourable if the display unit comprises at least one light-emitting diode arranged on a visible side of the actuating yoke or the housing. Preferably several, in particular three, light-emitting diodes are provided each of which emits a distinguishable light signal for a certain interval of actuating operations.

To facilitate the reading out of data stored in the computing or evaluating unit it is advantageous if the computing or evaluating unit is connected to an interface, in particular a USB interface for data transmission to an external device. The (USB) interface is preferably provided at a place of the stamp housing easily accessible from the outside; data transmission is effected, as is well known in the art, by attaching a suitable transmission cable connected to an external device, in particular a personal computer.

BRIEF DESCRIPTION OF THE DRAWINGS

The invention will now be explained in more detail by way of examples illustrated in the drawing to which, however, it shall not be limited. In the drawing

DETAILED DESCRIPTION OF THE DRAWINGS

Figure 1:
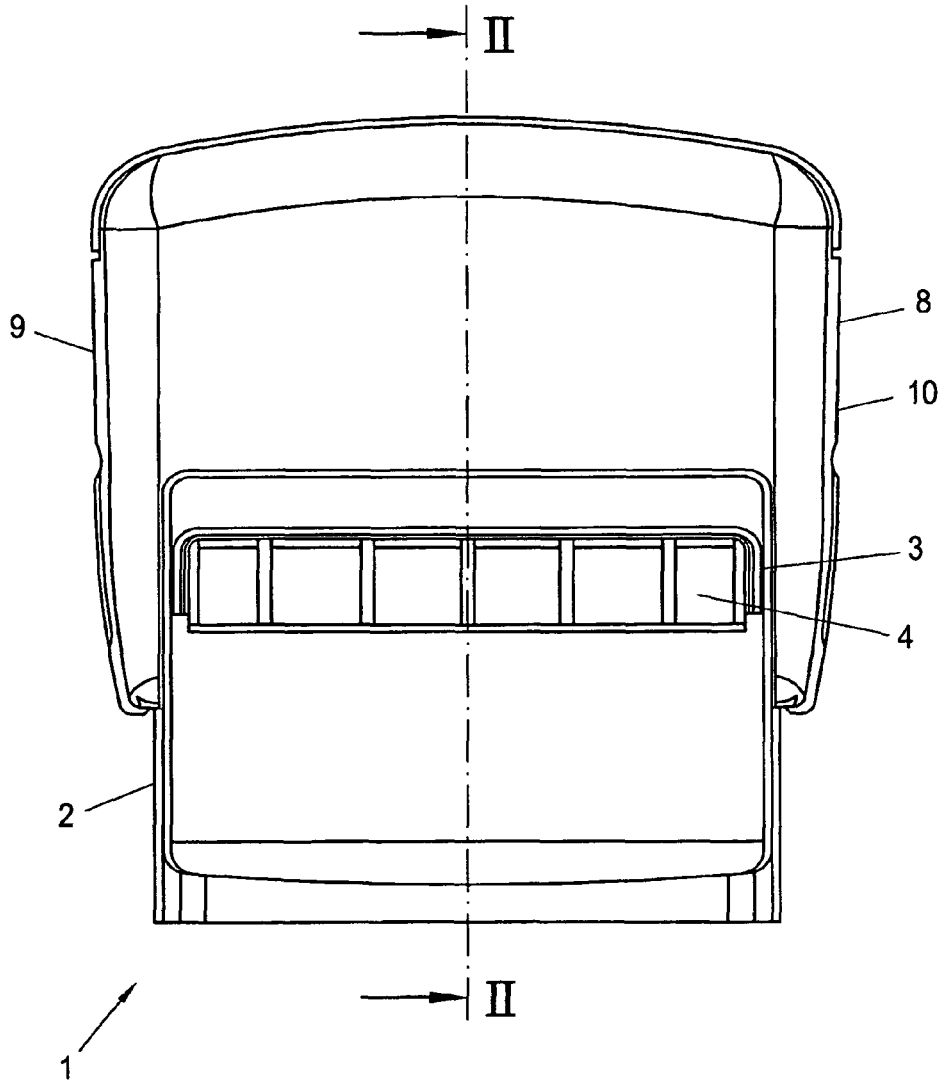
FIG. 1 shows a view of a self-inking stamp known as such comprising a hood-like actuating yoke placed on top of the stamp housing and movable into an actuating position corresponding to a print position.
Figure 2:
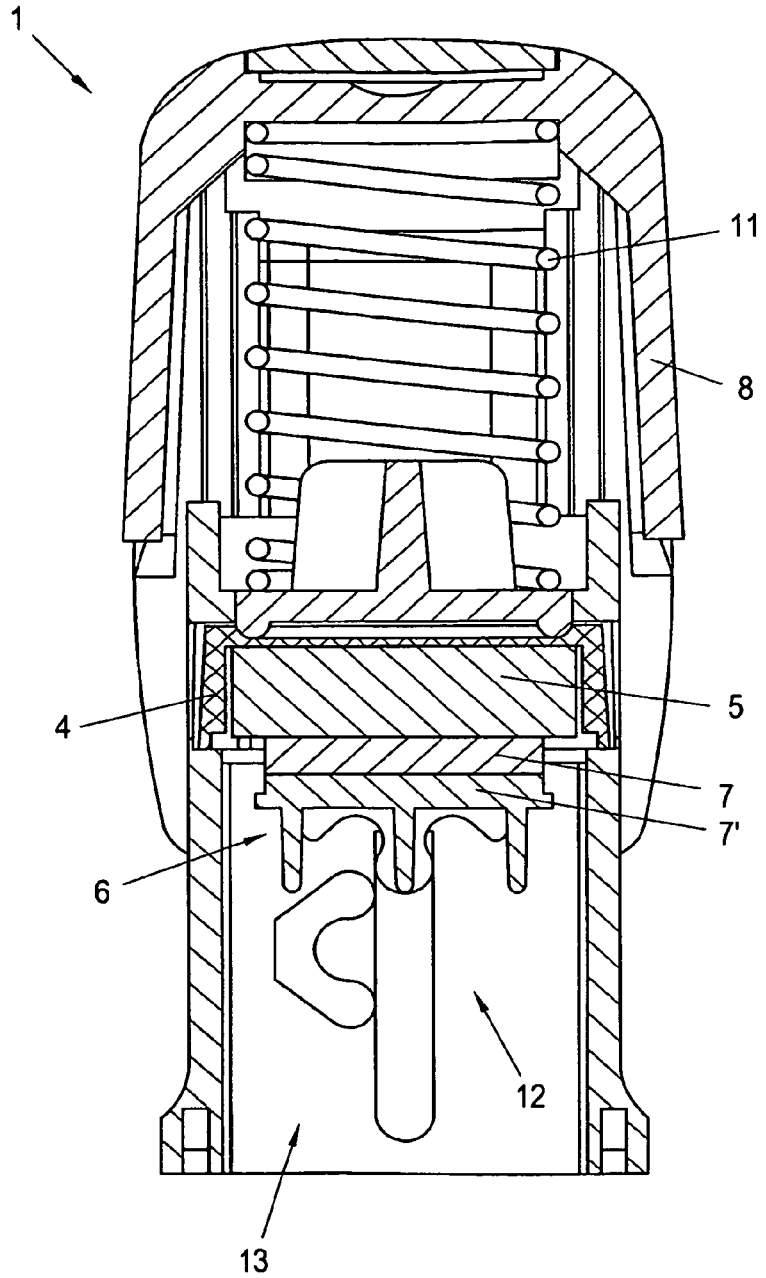
FIG. 2 shows a vertical section through the self-inking stamp of FIG. 1 along line II-II in FIG. 1.

FIGS. 1 and 2 generally show a conventional self-inking stamp 1 comprising a stamp housing 2 (hereinafter called housing 2) shaped in the manner of a frame. The housing 2 comprises a slide-in compartment 3 for an ink pad holder 4 replaceably arranged therein, which ink pad holder 4 houses an ink pad 5 (see FIG. 2). Housing 2 also contains a stamping unit 6 which comprises a stamping plate 7 with stamp types attached to a stamping plate carrier 7'. The stamping unit 6 in FIG. 2 is shown in a colouring position in which it is supported against ink pad 5.

Actuation of the self-inking stamp 1 is effected by an actuating yoke 8 which is mounted on the housing 2 in the manner of a hood. The actuating yoke has arms 9, 10 which are inserted in suitable guides so as to be slidable therein, on the narrow side walls of housing 2. A spring 11 is active between actuating yoke 8 and housing 2, which spring 11 retains the actuating yoke 8 in its shown upper position and thus the stamping unit 6 in its colouring position. The movement of the actuating yoke 8 into its lower end or actuating position is transferred in the known manner via a turn-over mechanism 12 which is operable to pivot the stamping unit 6 from the colouring position into a print position intended for printing onto a print surface, and at the same time effect its downward movement. In the print position the stamping plate 7 together with the stamp types protrudes from a lower opening 13 of housing 2 thereby permitting an imprint to be produced on a print surface. The turn-over mechanism 12 comprises a cam control or a guide slot known in the state of the art in order to turn the stamping unit 6 by 180° into the print position when the actuating yoke 8 is operated.

Figure 3:
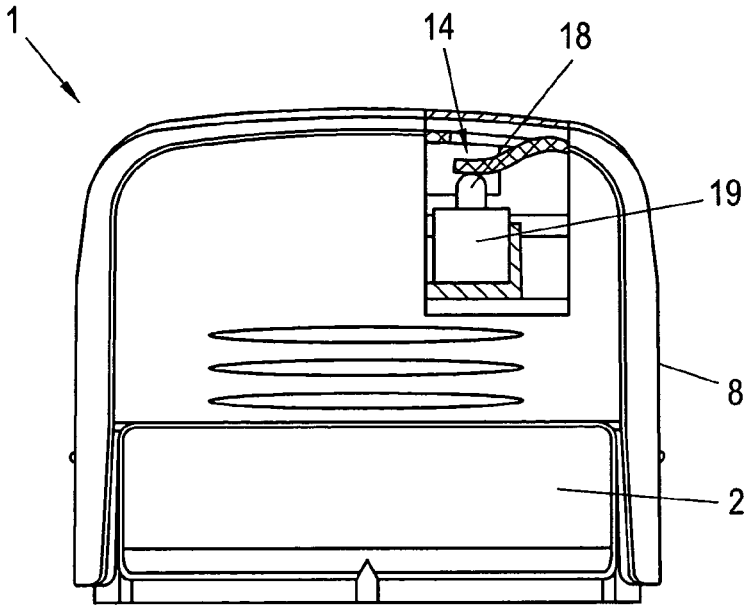
FIG. 3 shows a partially cut-away view of a self-inking stamp according to a first embodiment of the invention with electro-mechanical signal generating means for recording an actuating operation.
Figure 4:
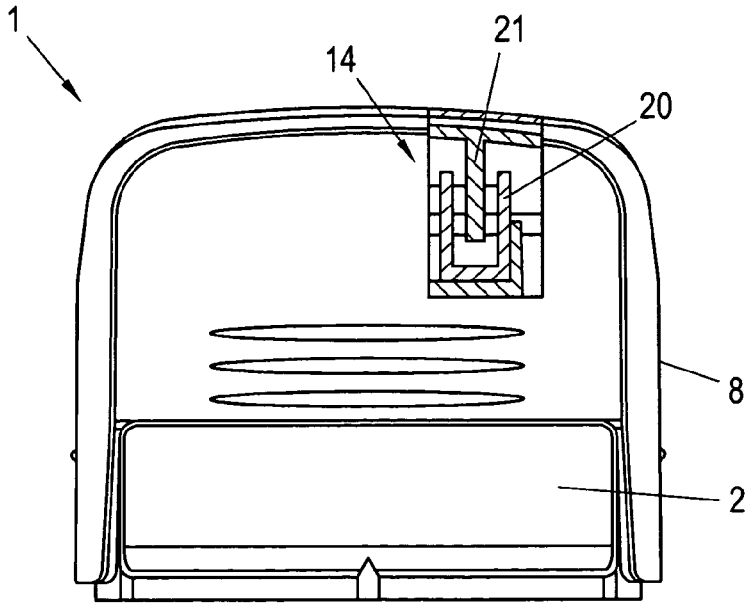
FIG. 4 shows a partially cut-away view of a self-inking stamp according to a further embodiment of the invention with electro-optical signal generating means.
Figure 5:
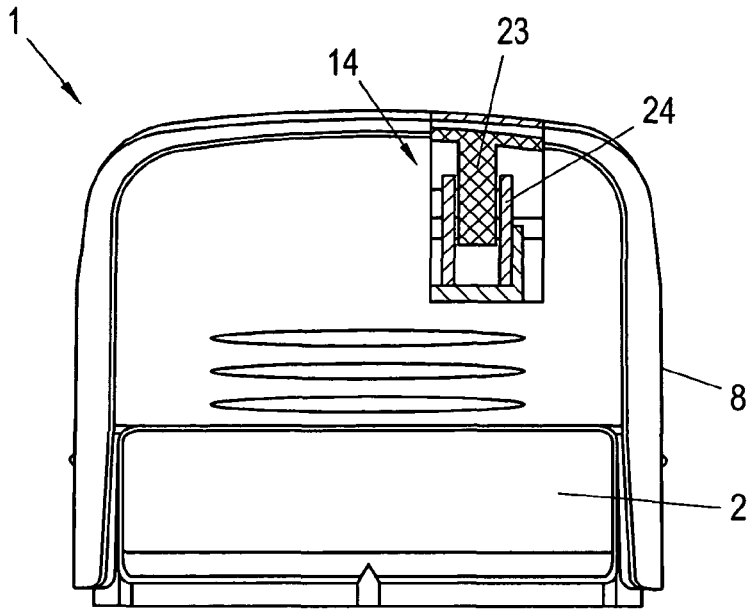
FIG. 5 shows a partially cut-away view of a self-inking stamp according to yet a further embodiment of the invention with inductive signal generating means.
Figure 6:
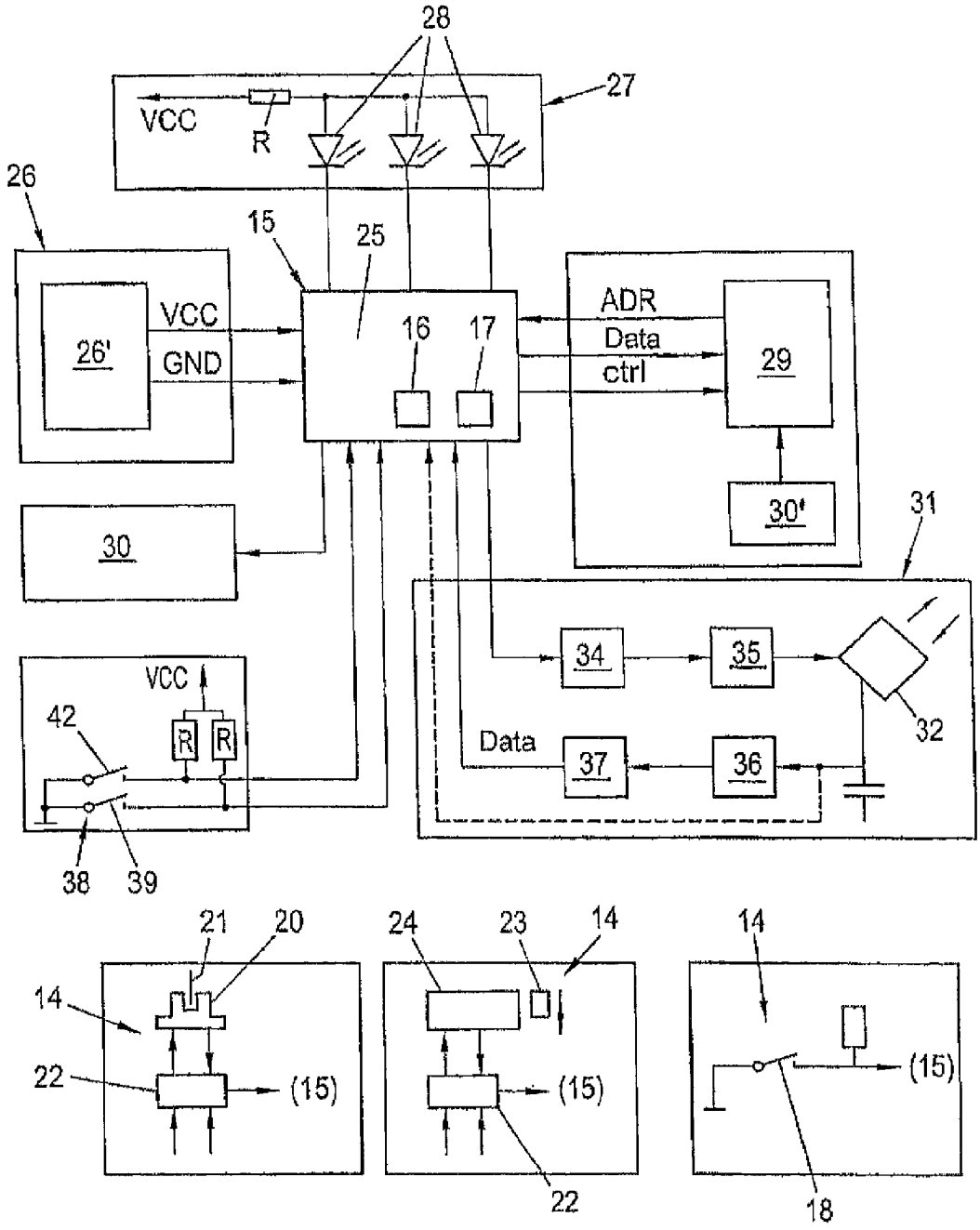
FIG. 6 shows a block diagram of an electrical circuit of a self-inking stamp according to FIGS. 3 to 5.

FIGS. 3 to 5 each schematically show an embodiment of a self-inking stamp 1 according to the invention which permits reliable recording of the actuating operations performed since the beginning, in order to gain information on the state of the ink pad 5 contained in the ink pad holder 4. To this end the self-inking stamp 1 comprises signal generating means 14 which record the movement of actuating yoke 8 into the actuating position corresponding to the print position of ink pad holder 4. An actuating operation is detected only if the actuating yoke 8 is moved a defined distance from its upper idling position; in order to avoid erroneous counts the actuating operation is not registered until the actuating position has been reached. The signal generating means 14 are coupled to an electronic computing or evaluating unit 15, which is shown schematically in FIG. 6. The electronic computing or evaluating unit 15 processes the signals supplied by the signal generating means 14, which contain information on the position of the actuating yoke 8. To simplify matters, FIG. 6 shows three different signal generating means 14 corresponding to FIGS. 3, 4 and 5, wherein, however, only one type of signal generating means 14 will, of course, be provided on a given self-inking stamp 1.

A movement of the actuating yoke 8 into the actuating position is an indication for a stamping operation which is recorded in order to monitor the state of the ink pad holder 4 or the ink pad 5 received therein. For this purpose the computing or evaluating unit 15 comprises a counting module 16 (schematically shown in the circuit diagram of FIG. 6) for counting the actuating operations performed; the counting module 16 is connected to a memory 17 of the computing or evaluating unit 15 (schematically shown in FIG. 6), where the constantly updated count is stored during operation.

In the embodiment of the self-inking stamp 1 shown in FIG. 3 electro-mechanical signal generating means 14 are provided which comprise a push button 18 arranged on the actuating yoke 8 which is closable by means of a contact element 19 attached to the housing 2. When the actuating yoke 8 is moved into its end or actuating position push button 18 reaches its contact or closing position relative to the contact; by closing the electrical contact an electric signal is produced which is recorded by the computing or evaluating unit 15 and registered as a stamping operation (see also FIG. 6). The counting module 16 then increments the count stored in memory 17 by a value of "1".

FIG. 4 shows an alternative embodiment of the electro-optical signal generating means 14 in the form of a photoelectric barrier as commonly used in the art. The photoelectric barrier comprises a transmitting/receiving unit 20 for transmitting or receiving light rays schematically shown in the drawing. Attached to the actuating yoke 8 is a photoelectric barrier 21 which is moved into the optical path of the transmitting/receiving unit 20 when operating the actuating yoke 8. Interruption of the light beam causes a change in the output signal of the transmitting/receiving unit 20 which is supplied to the computing or evaluating unit 15 in the form of an emitter signal. When the print position is reached therefore a stamping operation is signalled to the computing or evaluating unit 15. As can be seen in FIG. 6 a signal forming unit 22 is switched between the transmitting/receiving unit 20 and the computing or evaluating unit 15 in order to supply a suitable pulse signal to the computing or evaluating unit 15.

In FIG. 5 a further embodiment of the signal generating means 14 is shown which provides for inductively recording the actuating operations. For this purpose a suitable magnetic element 23 is attached to the actuating yoke 8, which, when the actuating yoke 8 is operated, is inserted into a magnetic sensor 24, for example a coil or a Reed sensor or Hall sensor. The inductive coupling between the trigger element 23 and the magnetic sensor 24 causes a change in an output voltage of the signal generating means 14 which in turn is conditioned in a signal recording unit 22 and is used for recording the actuating operation. When the change in the output voltage exceeds a threshold value corresponding to the arrival at the print position, the computing or evaluating unit 15 registers a stamping operation. Erroneous counts are reliably avoided in that an incomplete actuation, i.e. a movement of the actuating yoke 8 in sections, is not evaluated as a stamping operation.

In a further embodiment (not shown in the drawing) capacitive signal generating means 14 are provided which are composed of a capacitor preferably arranged in the housing 2 and a slidable dielectric element coupled to the actuating yoke 8. The capacity or the capacitor is monitored by means of an electric circuit. When the actuating yoke 8 is operated the dielectric element is moved in between the capacitor plates thereby causing a change in the capacitor charge which is used for recording a stamping operation.

As can be seen in FIG. 6, the signal generating means 14 can also be formed using a magnetic sensor 24, in particular a Reed relay or a Hall sensor, which is operable by means of a magnet 23. The magnetic sensor 24 or magnet 23 is attached to the housing 2 or the actuating yoke 8. When the actuating yoke 8 is moved into its actuating position the magnet 23 moves towards the magnetic sensor 24 as indicated by an arrow in FIG. 6; in the case of a Reed relay, as the magnetic sensor 24 approaches, a contact open in the idling position is closed causing an emitter signal to be generated which is used for identifying the actuating operation. With a Hall sensor the Hall voltage caused by the magnet 23 is used as an emitter signal for recording the actuating operation.

FIG. 6 further shows generally the interconnections of the electronic components of the self-inking stamp 1. The electro-optical, magnetic and electro-mechanical signal generating means 14 are shown in the lower part of FIG. 6; it is of course understood that only of the above-mentioned alternatives suffices for recording the stamping operations in the counting module 16 of the computing or evaluating unit 15. Transmission of the signals is effected respectively via a signal line (not shown in detail in FIG. 6) which is adapted to be connected to the computing or evaluating unit 15.

The computing or evaluating unit 15 is preferably formed using a micro controller 25 which is connected to a power supply 26. Conveniently the power supply 26 comprises a battery 26', in particular a double-layer capacitor battery known under the brand name of "Goldcap".

Figure 10:
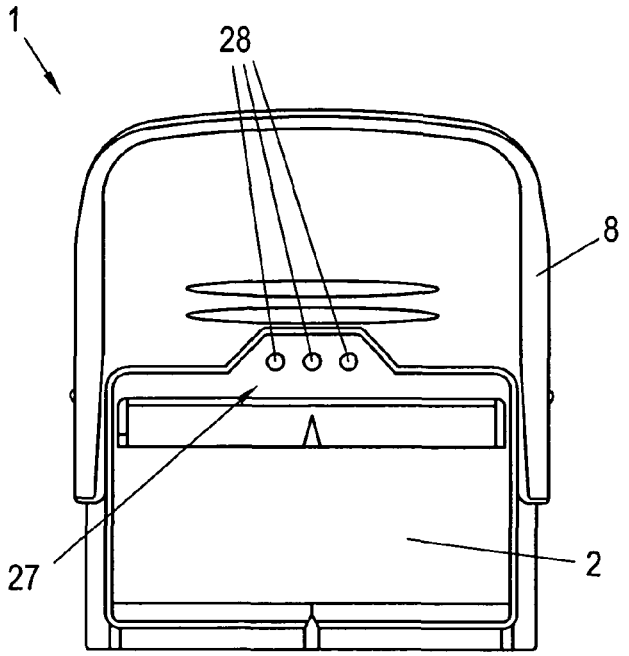
FIG. 10 shows a view of a self-inking stamp with light-emitting diodes arranged on the stamp housing for illustrating the number of performed actuating operations.

As also shown in FIG. 6, the computing or evaluating unit 15 is connected to a display unit 27 in order to convey to the user information on the self-inking stamp 1. The display unit 27 comprises a LCD unit with three light-emitting diodes 28 in three different colours (red, yellow green) which according to the embodiment shown in FIG. 10 are arranged centrally on a broad-side wall of housing 2. The light-emitting diodes 28 each signal a certain interval of the recorded actuating operations. For example, a green LED can indicate that since starting to use the ink pad holder 4 less than 4000 stamping operations were carried out. In this case, it may be assumed that the ink pad 5 still contains a sufficient amount of ink. In the interval between 4000 and 5000 actuations a yellow LED 28 may shine indicating that the amount of ink left in the ink pad 5 is beginning to run out. Finally, a red LED 28 which begins to shine after 5000 actuations may indicate that the ink pad 5 is exhausted and should be replaced.

The display unit 27 further comprises an indicating panel 29 arranged on a visible side of housing 2 or of actuating yoke 8 for indicating the exact number of stamping operations already carried out. The indicating panel 29 is preferably shaped as an LCD panel connected to a contrast voltage source 30'.

Figure 9:
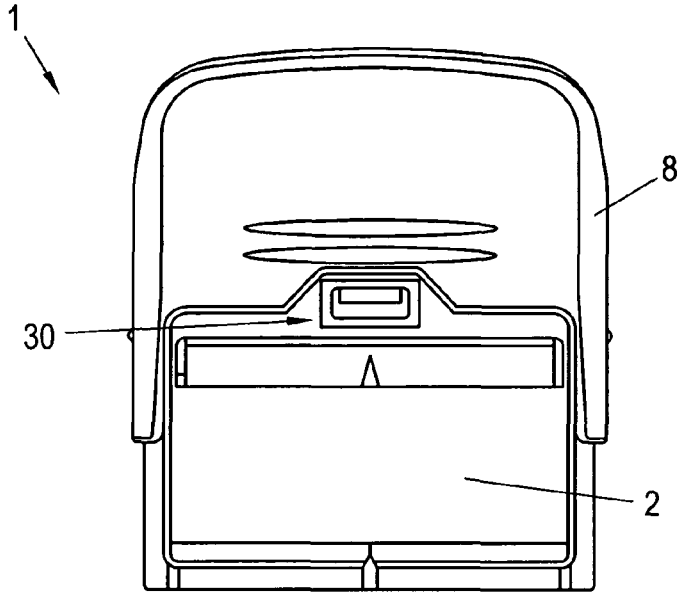
FIG. 9 shows a view of a self-inking stamp with a USB interface for data transmission to an external device.

As further shown in FIG. 6 in conjunction with FIG. 9, a conventional interface 30 known as such is provided in order to be able to transfer the data stored in memory 17 of the computing or evaluating unit 15 to an external device. In the embodiment shown, a USB interface (Universal Serial Bus) commonly used in the art is provided which does not need any further explanation. As shown in FIG. 9, the USB interface is arranged on housing 2 of the self-inking stamp 1. A suitable USB cable is attached for data transmission.

Figure 11:
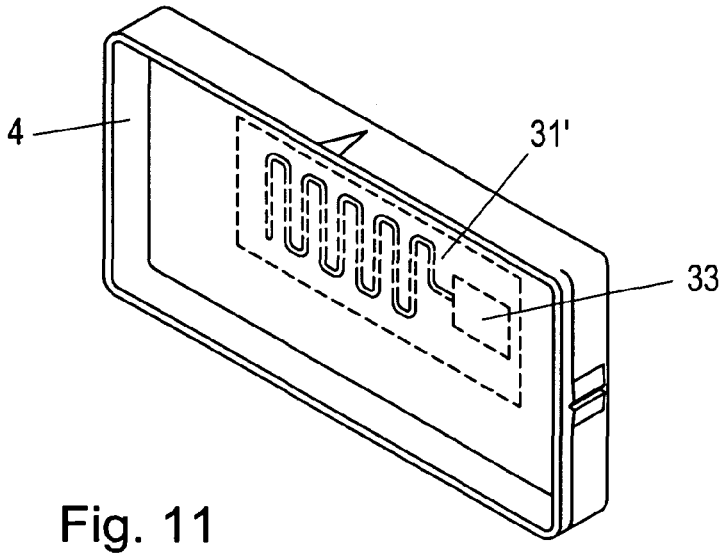
FIG. 11 shows a perspective view of an ink pad holder with a RFID transponder for identifying the ink pad holder by means of a reading device on the stamp.

As shown in FIG. 6 in conjunction with FIG. 11, the computing or evaluating unit 15 is connected to a transponder circuit 31 for communicating with a RFID transponder 31' (RFID=radio frequency identification) during operation. The transponder 31' is used to identify the ink pad holder 4 by means of an external reading device. The design of such a RFID transponder 31' is well known in the art, thus making any further explanation unnecessary at this point. In order to read out (code) data contained in the RFID transponder 31' the reading device, i.e. circuit 31, generates an electro-magnetic alternating field to which the RFID transponder 31' (also referred to RFID tag) is exposed. The field energy absorbed via an aerial 32 of the reading device is used as a power supply during a communication operation when dealing with passive transponder units 31'. The activated transponder 31' decodes the commands sent from the reading device 31; it influences or modulates the irradiated electro-magnetic field when transferring information to the reading device 31. The transponder 31' is attached to the ink pad holder 4 in order to localise or identify the built-in ink pad holder 4 by way of an individual serial number. The serial number of the respective ink pad holder 4 can be read out from the reading device 31 upon request. Further, the RFID transponder 31' comprises a memory 33 (schematically shown in FIG. 11) which in the built-in state of the ink pad holder 4 is connected to the computing or evaluating unit 15 in order to obtain the count recorded by the counting module 16. The data transmitted from the computing or evaluating unit 15 to the memory 33 of the RFID transponder 31' can be read from the memory 33 by means of the reading device. Alternatively or additionally, data transmission may be effected, as mentioned, via the USB interface 30. The transponder circuit 31 comprises, as shown in FIG. 6, a high frequency part 34, in particular a high frequency choke, and an output stage 35 functioning as a transmitting part. The computing or evaluating unit 15 transmits a carrier square wave signal, for example at 125 kHz, to the high frequency part 34 which in turn supplies a sinusoidal carrier signal to the output stage 35. The transponder circuit 31 further comprises a rectifier filter circuit 36 which receives a modulated signal from the aerial 32. The rectifier filter circuit 36 supplies a filtered signal without the carrier frequency to a logic circuit 37 adapted to process the received data and the logic circuit transmits the processed data to the computing or evaluating unit 15.

Figure 7:
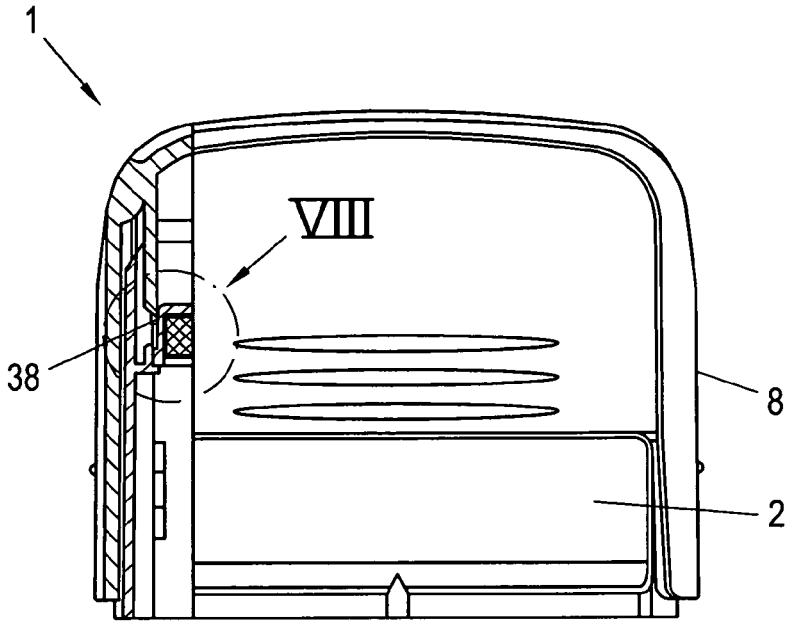
FIG. 7 shows a schematic partially opened up view of a self-inking stamp comprising a detachable strap for identifying an unused ink pad holder according to a preferred embodiment of the invention.
Figure 8:
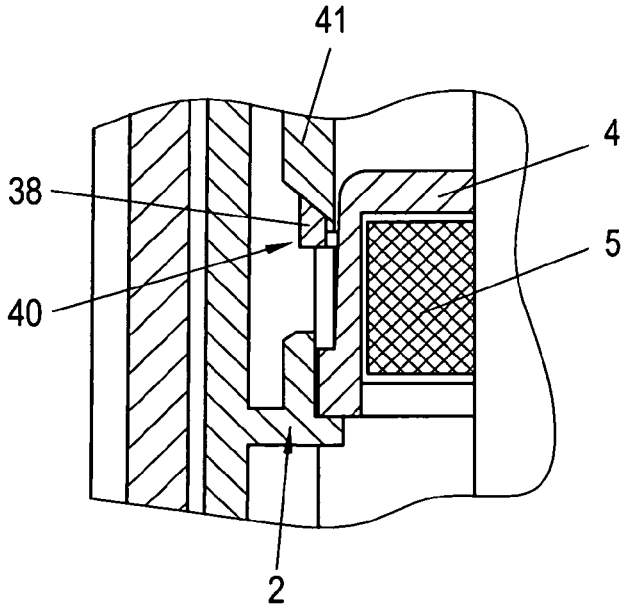
FIG. 8 shows an enlarged view of the detail illustrated in a circle VIII in FIG. 7.

As shown in FIG. 6 in conjunction with FIG. 7 and FIG. 8, marking means 38 are provided which are adapted to record a first time actuation of the actuating yoke 8 in order to be able to differentiate between an unused or new state of the ink pad holder 4 and a used state. The marking means 38 comprise a switching means 39 which is switched over when the ink pad holder 4 is used for the first time by operating the actuating yoke 8.

According to the embodiment shown in FIG. 7 or FIG. 8 a lug or strap 40 is provided which is attached to the ink pad holder 4, for example by being glued to it or by being formed in one piece with the ink pad holder 4, which lug or strap is broken off when the actuating yoke 8 is moved into the actuating position for the first time. Separating the lug 40 is effected by a projection protruding from the actuating yoke 8 which projection 41 hits the lug 40 during the first actuating operation and separates it as it moves further in direction of the actuating position. In order to ease separation of the strap 40 the contact surfaces between the strap 40 and the projection 41 are tapered. In the unused state of the ink pad holder 4 an electrical contact of the switching means 39 shaped as a push button is closed via lug 40 which is interrupted as the lug 40 is separated (see FIG. 6). This change in the switching state of the switching means 39 is recorded by the computing or evaluating unit 15 in order to determine first-time use of the ink pad holder 4. The information on the state of the ink pad holder 4 can be stored in the memory 17 of the computing or evaluating unit 15 or in the memory 33 of the RFID transponder 31' and read out as needed.

In order to check for the presence of an ink pad holder 4 in the slide-in compartment 3 the computing or evaluating unit 15 is connected to a further switching member or means 42 given by a push button which is switched over into the respectively other switching state during insertion/removal of the ink pad holder. When the ink pad holder 4 is inserted into the slide-in compartment 3, an electrical contact is preferably closed via the further switching 42 which contact is monitored by the computing or evaluating unit 15. When the ink pad holder 4 is removed, the switching means 42 returns to its idling state, whereby the electrical contact is interrupted.

The computing or evaluating unit 15 is adapted to monitor the switching state of switching means 39, 42 in order to determine the presence of the ink pad holder 4 in the slide-in compartment 3 on the one hand and on the other, to determine the state of the inserted ink pad holder 4. The monitored switching states of the switching means 39, 42 may be used for initialising or resetting the count of the counting module 16, when it is detected that a new ink pad holder 4 comprising an unused ink pad 5 has been inserted. After resetting the count the stamping operations are recorded beginning with zero.

The invention claimed is:

1. A self-inking stamp, comprising a housing, in which an ink pad holder adapted to receive an ink pad and a stamping unit comprising stamp types are arranged, wherein the ink pad holder is replaceably arranged in the housing, an actuating member slidably mounted on the housing, which actuating member is coupled with a turn-over mechanism for pivoting the stamping unit between a coloring position in which it is held against the ink pad in the ink pad holder and a print position provided for printing on a print surface, a signal generator adapted to record actuating operations, said actuating operations comprising a movement of the actuating member into an actuating position corresponding to the print position, an electronic evaluating unit, which is connected to the signal generator for processing a signal supplied by the signal generator, wherein the evaluating unit comprises a counting module for counting the actuating operations, and a switching member connected to the evaluating unit, which switching member is arranged to be switched from a first switching state to a second switching state when the ink pad holder is inserted or removed.

2. Self-inking stamp according to claim 1, wherein the evaluating unit is adapted to reset the counting module when an unused ink pad holder is inserted.

3. Self-inking stamp according to claim 2, wherein the evaluating unit is adapted to continuously monitor the first and second switching state of the switching member, which is arranged to signal the presence of the ink pad holder or the state of the ink pad holder.

4. Self-inking stamp according to claim 1, wherein the signal generator is an electro-mechanical signal generator.

5. Self-inking stamp according to claim 4, wherein the electro-mechanical signal generator is a push-button.

6. Self-inking stamp according to claim 1, wherein the signal generator is an electro-optical signal generator.

7. Self-inking stamp according to claim 6, wherein the electro-optical signal generator is a photo-electric barrier.

8. Self-inking stamp according to claim 1, wherein the signal generator is an inductive or capacitive signal generator.

9. Self-inking stamp according to claim 1, wherein the ink pad holder comprises a transponder for identifying the ink pad holder by means of a reading device.

10. Self-inking stamp according to claim 9, wherein the transponder is a RFID transponder.

11. Self-inking stamp according to claim 9, wherein the transponder comprises a memory containing the number of actuating operations recorded by the counting module.

12. Self-inking stamp according to claim 1, wherein the ink pad holder comprises a marker for detecting an unused or used state of the ink pad holder.

13. Self-inking stamp according to claim 12, wherein the marker comprises a lug attached to the ink pad holder, which is detached when the actuating member is moved into the actuating position for a first time.

14. Self-inking stamp according to claim 13, wherein the lug, in the unused state of the ink pad holder, makes a contact with a switching means connected to the evaluating unit, which contact is broken when the lug is detached.

15. Self-inking stamp according to claim 1, wherein the evaluating unit is a micro controller.

16. Self-inking stamp according to claim 1, wherein the evaluating unit is connected to a display unit for issuing a display signal depending on the number of actuating operations.

17. Self-inking stamp according to claim 16, wherein the display unit comprises at least one light-emitting diode arranged on a visible side of the actuating member or the housing.

18. Self-inking stamp according to claim 1, wherein the evaluating unit is connected to an interface, for data transmission to an external device.

19. Self-inking stamp according to claim 18, wherein the interface is a USB interface.

* * * * *

UNITED STATES PATENT AND TRADEMARK OFFICE

CERTIFICATE OF CORRECTION

PATENT NO. : 8,695,500 B2
APPLICATION NO. : 13/199718
DATED : April 15, 2014
INVENTOR(S) : Ernst Faber It is certified that error appears in the above-identified patent and that said Letters Patent is hereby corrected as shown below:

In particular, on the title page, Item [73], the name of the Assignee, should correctly read:

--Colop Stempelerzeugung Skopek Gesellschaft m.b.H. & Co. KG--.

Signed and Sealed this
First Day of July, 2014

Michelle K. Lee

Michelle K. Lee
*Deputy Director of the United States Patent and Trademark Office*